US007241815B2

(12) United States Patent
Roy-Auberger et al.

(10) Patent No.: US 7,241,815 B2
(45) Date of Patent: Jul. 10, 2007

(54) PROCESS FOR SYNTHESISING HYDROCARBONS IN A THREE-PHASE REACTOR IN THE PRESENCE OF A CATALYST COMPRISING A GROUP VIII METAL SUPPORTED ON ZIRCONIA OR ON A ZIRCONIA-ALUMINA MIXED OXIDE

(75) Inventors: Magalie Roy-Auberger, Bourgoin Jallieu (FR); Renaud Revel, Houilles (FR); Virginie Tissot, Malakoff (FR); Dan Ion Enache, Rueil Malmaison (FR); Roberto Zennaro, Milan (IT); Giovanni Pederzani, Milan (IT)

(73) Assignees: Institut Francais du Petrole, Cedex (FR); ENI S.p.A., E. Mattei (IT)

( * ) Notice: Subject to any disclaimer, the term of this patent is extended or adjusted under 35 U.S.C. 154(b) by 223 days.

(21) Appl. No.: 11/076,033

(22) Filed: Mar. 10, 2005

(65) Prior Publication Data

US 2005/0282917 A1 Dec. 22, 2005

Related U.S. Application Data

(63) Continuation of application No. 10/492,481, filed as application No. PCT/fr02/03145 on Oct. 8, 2002.

(30) Foreign Application Priority Data

Oct. 11, 2001 (FR) ..... 01 13138

(51) Int. Cl.
*C07C 27/00* (2006.01)

(52) U.S. Cl. ..... 518/715; 518/700

(58) Field of Classification Search ..... 518/700, 518/715

See application file for complete search history.

(56) References Cited

U.S. PATENT DOCUMENTS 5,217,938 A * 6/1993 Reinalda et al. ..... 502/325

* cited by examiner

*Primary Examiner*—J. Parsa
(74) *Attorney, Agent, or Firm*—Millen, White, Zelano & Branigan

(57) ABSTRACT

A process is described for synthesising hydrocarbons from a mixture comprising carbon monoxide and hydrogen and possibly carbon dioxide $CO_2$, in the presence of a supported catalyst comprising at least one group VIII metal. The support comprises zirconia or a mixed zirconia-alumina oxide and the zirconia is present in the quadratic and/or amorphous form. Said catalyst is used in a liquid phase in a three-phase reactor.

13 Claims, No Drawings

PROCESS FOR SYNTHESISING HYDROCARBONS IN A THREE-PHASE REACTOR IN THE PRESENCE OF A CATALYST COMPRISING A GROUP VIII METAL SUPPORTED ON ZIRCONIA OR ON A ZIRCONIA-ALUMINA MIXED OXIDE

This application is a continuation of U.S. application Ser. No. 10/492,481 filed Apr. 12, 2004, which is a U.S. National Phase of PCT/FR02/03415 filed Oct. 8, 2002.

The present invention relates to a process for synthesising hydrocarbons from a mixture comprising CO—($CO_2$)—$H_2$, i.e., a mixture comprising carbon monoxide, hydrogen and possibly carbon dioxide, known as synthesis gas. That process comprises using a catalyst comprising at least one group VIII metal supported on a particular zirconia or a mixed zirconia-alumina oxide.

The skilled person is aware that synthesis gas can be converted to hydrocarbons in the presence of a catalyst containing transition metals. Such conversion, carried out at high temperatures and under pressure, is known in the literature as the Fischer-Tropsch synthesis. Metals from group VIII of the periodic table such as iron, ruthenium, cobalt and nickel catalyse the transformation of CO—($CO_2$)—$H_2$ mixtures, i.e., a mixture of carbon monoxide, hydrogen and possibly carbon dioxide, to liquid and/or gaseous hydrocarbons.

Different methods have been described and developed in the prior art that are intended to improve the preparation of Fischer-Tropsch catalysts based on cobalt supported on different supports. The most widely used supports are alumina, silica and titanium dioxide, occasionally modified by additional elements.

WO-A-99/42214 describes adding a stabilising element to an $Al_2O_3$ support used to prepare a catalyst active in the Fischer-Tropsch synthesis. The stabilising element can be Si, Zr, Cu, Zn, Mn, Ba, Co, Ni and/or La. It can substantially reduce the solubility of the support in acid or neutral aqueous solutions. It is added to the pre-formed alumina support.

U.S. Pat. No. 5,169,821 and U.S. Pat. No. 5,397,806 describe including silicon, zirconium or tantalum in a cobalt-based catalyst supported on $TiO_2$ in the form of anatase to stabilise it to high temperature regeneration.

European patent application EP-A-0 716 883 describes catalysts and catalytic supports essentially formed by monoclinic zirconia prepared from zirconium nitrate or zirconium chloride in an aqueous solution. After adding metals such as nickel, copper, cobalt or platinum, such catalysts can be used to carry out a variety of reactions, in particular for the Fischer-Tropsch synthesis.

U.S. Pat. No. 5,217,938 describes a process for preparing a zirconia-based catalyst optionally containing additional metals from groups IB-VIIB and VIII, preferably group VIII. The catalyst is in the form of extrudates and is used for the Fischer-Tropsch synthesis.

European patent application EP-A-0 908 232 describes the preparation of an acidic catalyst containing a substantial quantity of bulk or supported sulphated zirconia in the crystalline (monoclinic or quadratic) form and a hydrogenating transition metal. That catalyst is used in chemical reactions for transforming hydrocarbons requiring the use of an acidic catalyst, such as paraffin, olefin, cyclic compounds or aromatic compound isomerisation, alkylation reactions, oligomerisation reactions or dehydrating light hydrocarbons.

However, known prior art catalysts used in the Fischer-Tropsch synthesis have a high selectivity for the lightest hydrocarbons, in particular methane, which is undesirable, to the detriment of its selectivity for heavier hydrocarbons, i.e., hydrocarbons containing at least five carbon atoms per hydrocarbon chain. The present invention proposes to overcome this disadvantage, linked in particular to the structure and type of catalyst used for converting synthesis gas, and aims to modify the distribution of the products formed during the Fischer-Tropsch synthesis by improving the production of hydrocarbons containing at least five carbon atoms per hydrocarbon chain.

Thus, the present invention provides a process for synthesising hydrocarbons from a mixture comprising carbon monoxide and hydrogen (CO—$H_2$) and possibly carbon dioxide $CO_2$, in the presence of a supported catalyst comprising at least one group VIII metal, the support comprising zirconia or a mixed zirconia-alumina oxide and in which the zirconia is in the quadratic and/or amorphous form. Preferably, the catalyst is used in suspension in a liquid phase in a three-phase reactor, generally termed a slurry reactor. Usually, the three-phase reactor is of the slurry bubble column type.

The Applicant has surprisingly discovered that using a support comprising zirconia in the quadratic and/or amorphous form, optionally containing an alumina phase, after impregnation with at least one group VIII metal, preferably cobalt, can produce a catalyst that is more active and more selective than prior art catalysts in the process for synthesizing hydrocarbons from a mixture comprising carbon monoxide and hydrogen. Such catalysts have particularly stable performances and result in converting synthesis gas into a mixture of straight-chain saturated hydrocarbons containing at least 50% by weight of C5+ hydrocarbons and less than 20% of methane with respect to the hydrocarbons formed. Further, the use of such a catalyst in suspension in a liquid phase in a three-phase reactor can produce a solid that is stabilized as regards attrition phenomena. Further again, said catalyst has improved mechanical strength compared with a catalyst formed from an alumina support alone or titanium dioxide, the mechanical strength being determined by measuring the change in particle size over a given test period when operating a slurry bubble column.

The quadratic type crystalline structure of the zirconia is characterized by X ray diffraction. For such a structure, determining the diffraction diagram leads to a crystallographic structure wherein the angles $\alpha$, $\beta$ and $\gamma$ are 90° and wherein the lattice parameters are such that $a=b\neq c$. Amorphous zirconia is characterized by the absence of any significant diffraction peak on the diffraction diagram.

It is essential to carrying out the hydrocarbon synthesis process of the invention that the zirconia in the catalytic support should be completely free of monoclinic type crystalline structure. Further, it must not be sulphated.

The support used in the hydrocarbon synthesis process of the present invention contains at least 10% by weight of zirconia in the quadratic form and/or amorphous form with respect to the total support weight and contains 0 to 90% by weight of $Al_2O_3$, preferably 1% to 75%, more preferably 5% to 60% by weight of $Al_2O_3$ with respect to the total support weight.

Advantageously, the support comprising zirconia or a mixed zirconia-alumina oxide and in which the zirconia is in the quadratic and/or amorphous form has a specific surface area of more than 50 $m^2/g$, preferably more than 80 $m^2/g$ and more preferably more than 100 $m^2/g$.

Thus, any zirconia synthesis process that is known to the skilled person resulting in a quadratic and/or amorphous zirconia advantageously with a specific surface area of more than 50 $m^2$ μg is suitable for preparing the catalyst supports used in the hydrocarbon synthesis process of the invention. When the support comprises a mixed zirconia-alumina oxide, an alumina phase is associated with the zirconia in the quadratic and/or amorphous form.

By way of example, the support for the catalyst used in the hydrocarbon synthesis process of the invention can be prepared by precipitation per se or by co-precipitation from an aqueous solution, under controlled static conditions (pH, concentration, temperature, mean residence time) by reacting an acidic solution containing zirconium, for example zirconium nitrate or zirconium chloride, optionally aluminium, for example aluminium sulphate or aluminium nitrate, with a basic solution such as ammonia or hydrazine. A particular method for preparing such supports derives from the disclosure in EP-A-0 908 232 and consists of co-precipitating $ZrO(NO_3)_2$ and $Al(NO_3)_3$ at a pH of 9. A further method inspired by the work of Gao (*Top. Catal.,* 6 (1998), 101) consists of co-precipitating $ZrOCl_2$ and $Al(NO_3)_3$ with ammonia. A further preferred method consists of precipitating $ZrO(NO_3)_2$ with hydrazine, in the presence or absence of $Al(NO_3)_3$ such as in the method cited by Ciuparu (*J. Mater. Sci. Lett.* 19 (2000) 931).

The support is then obtained by filtering and washing, drying with forming then calcining. The unitary drying and forming step is preferably carried out by spray drying, which can produce substantially spherical microbeads less than 500 microns in size. After drying, the product is preferably calcined in air and in a rotary oven at a temperature in the range 400° C. to 1200° C., preferably in the range 400° C. to 800° C. and for a time sufficient for the BET specific surface area of the support advantageously to have a value of more than 50 $m^2$ μg, preferably more than 80 $m^2/g$ and still more preferably more than 100 $m^2/g$.

Finally, throughout the methods cited above, it may be desirable to add a minor proportion of at least one stabilizing element selected from the group formed by silicon, niobium, lanthanum, praseodymium and neodymium. The stabilizing element is added in a proportion of 0.5% to 5% by weight with respect to the preformed zirconia or zirconia-alumina support in the form of a soluble salt, for example the nitrate.

In general, the support is in the form of a graded fine powder with a grain size of less than 500 microns, preferably in the range 10 to 150 microns and more preferably in the range 20 to 120 microns, for optimum use in the presence of a liquid phase in the slurry bubble column. Advantageously, the support has the following textural properties: a pore volume of more than 0.1 $cm^3/g$ and a mean pore diameter of more than 6 nm, preferably more than 8 nm.

The catalyst used in the hydrocarbon synthesis process of the invention comprises at least one metal from group VIII of the periodic table, supported on a quadratic and/or amorphous zirconia optionally containing an alumina phase and/or optionally, at least one stabilizer. The element from group VIII of the periodic table is selected from the group formed by iron, cobalt and ruthenium. Preferably, the group VIII metal is cobalt. The weight content of the metal from group VIII is generally in the range 0.1% to 50%, preferably in the range 1% to 30% with respect to the total catalyst weight. One particularly suitable technique for preparing the catalyst is impregnation of the support comprising zirconia or a mixed zirconia-alumina oxide with an aqueous solution of a precursor of the metal from group VIII of the periodic table, preferably cobalt, for example an aqueous solution of salts such as cobalt nitrates.

The catalyst can also contain other additional elements, in particular activity promoters, such as at least one element selected from ruthenium, molybdenum and tantalum, or reducibility promoters such as platinum, palladium or ruthenium. The weight content of an additional element with respect to the total catalyst weight is generally in the range 0.01% to 5%. These additional elements can be introduced at the same time as the metal from group VIII or in a subsequent step.

In a particular implementation of the invention, the catalyst contains cobalt and ruthenium.

In a further particular implementation of the invention, the catalyst contains cobalt and tantalum.

With a view to being used in the hydrocarbon synthesis process of the invention, the catalyst comprising at least one group VIII metal impregnated into the support comprising a quadratic and/or amorphous zirconia and optionally containing an alumina phase is subjected to drying and calcining steps, then it is pre-reduced by at least one reducing compound, for example selected from the group formed by hydrogen, carbon monoxide and formic acid, optionally brought into contact with an inert gas such as nitrogen, for example in a reducing compound/(reducing compound+inert gas) molar ratio that is in the range 0.001:1 to 1:1. Reduction can be carried out in the gas phase at a temperature in the range 100° C. to 600° C., preferably in the range 150° C. to 400° C., at a pressure in the range 0.1 to 10 MPa and at an hourly space velocity in the range 100 to 40000 volumes of mixture per volume of catalyst per hour. This reduction can also be carried out in the liquid phase, the catalyst being suspended in an inert solvent, for example a paraffinic cut comprising at least one hydrocarbon containing at least 5, preferably at least 10 carbon atoms per molecule if subsequently the hydrocarbon synthesis reaction is carried out in a liquid phase comprising at least one hydrocarbon containing at least 5, preferably at least 10 carbon atoms per molecule.

Conversion of the synthesis gas into hydrocarbons is then carried out at a total pressure that is normally in the range 0.1 to 15 MPa, preferably in the range 1 to 10 MPa, the temperature generally being in the range 150° C. to 350° C., preferably in the range 170° C. to 300° C. The hourly space velocity is normally in the range 100 to 20000 volumes of synthesis gas per volume of catalyst per hour, preferably in the range 400 to 5000 volumes of synthesis gas per volume of catalyst per hour, and the $H_2/CO$ ratio in the synthesis gas is normally in the range 1:2 to 5:1, preferably in the range 1.2:1 to 2.5:1.

The catalyst is preferably used in the form of a graded fine powder with a grain size of less than 500 microns, preferably in the range 10 to 150 microns and more preferably in the range 20 to 120 microns, in the presence of a liquid phase that can be constituted by at least one hydrocarbon containing at least 5, preferably at least 10 carbon atoms per molecule.

The use of a catalyst in suspension in a liquid phase in a three-phase slurry bubble column type reactor is advantageous as this type of operation allows optimum use of the catalyst performance (activity and selectivity), by limiting intra-granular diffusional phenomena, and a very substantial limitation of thermal effects in the catalyst grain, which is surrounded by a liquid phase. This type of operation involves separating the catalyst from the reaction products. Under such conditions, the catalyst has improved mechanical properties, allowing separation of the catalyst and optimum products and an increased service life of said improved catalyst.

The following examples illustrate the invention without, however, limiting its scope. In the examples, the percentages given are percentages by weight.

EXAMPLE 1 (IN ACCORDANCE WITH THE INVENTION)

Catalyst A

A catalyst A, $Co/ZrO_2$, was prepared by impregnating cobalt nitrate onto zirconia powder. The cobalt metal content was 13%.

The zirconia had previously been prepared by precipitating zirconium nitrate with hydrazine: it was amorphous and had a specific surface area of 250 $m^2/g$ after calcining at 550° C. The suspension obtained was spray dried and the support obtained was in the form of a powder with a grain size in the range 20 to 150 microns. The catalyst from the impregnation step was dried and calcined at 400° C.

EXAMPLE 2 (IN ACCORDANCE WITH THE INVENTION)

Catalyst B

A catalyst B, $Co/ZrO_2$—$Al_2O_3$, was prepared by impregnating cobalt nitrate onto a zirconia-alumina. The cobalt metal content was 12.5%.

The zirconia-alumina had previously been prepared by co-precipitating a mixture of $ZrOCl_2$ and $Al(NO_3)_3$ to which $NH_4OH$ had been added. After drying and calcining at 700° C., the support was amorphous, with a specific surface area of 158 $m^2/g$. The support contained 15% of alumina. The catalyst from the impregnation step was dried and calcined at 400° C.

EXAMPLE 3 (IN ACCORDANCE WITH THE INVENTION)

Catalyst C

A catalyst C, $CO/ZrO_2$, was prepared by impregnating cobalt nitrate onto a zirconia. The cobalt metal content was 13%.

The zirconia had previously been prepared by precipitating $ZrOCl_2$ with $NH_4OH$ followed by ageing at a constant pH. After drying and calcining at 500° C., the zirconia was quadratic and had a specific surface area of 135 $m^2/g$. The catalyst from the impregnation step was dried and calcined at 400° C.

EXAMPLE 4 (IN ACCORDANCE WITH THE INVENTION)

Catalyst D

A catalyst D was prepared by impregnating cobalt nitrate onto a support containing 70% alumina, 25% of zirconia and 5% of silica. The cobalt metal content was 12%.

The support was prepared as described in Example 2 by co-precipitating a mixture of $ZrOCl_2$ and $Al(NO_3)_3$ to which $NH_4OH$ had been added. Simultaneously with the $NH_4OH$ addition, a small quantity of ammonium silicate was added to obtain the composition of the catalytic support that is described above. After drying and calcining at 550° C., the support obtained was amorphous and had a specific surface area of 90 $m^2$ μg. The catalyst from the impregnation step was dried and calcined at 400° C.

EXAMPLE 5 (COMPARATIVE)

Catalyst E

A catalyst E, $Co/Al_2\mathbf{0}_3$, was prepared by impregnating cobalt nitrate onto a support constituted by a Puralox Scca 5-170 alumina powder with a specific surface area of 180 $m^2/g$. The cobalt metal content was 12.5%. The alumina support used was in the form of a powder with a grain size in the range 20 to 150 microns. The catalyst from the impregnation step was dried and calcined at 400° C.

EXAMPLE 6 (COMPARATIVE)

Catalyst F

A catalyst F was prepared by impregnating cobalt nitrate onto a support containing 90% of alumina and 10% of zirconia. The cobalt metal content was 13%.

The support was prepared by impregnating zirconium isopropoxide onto a Puralox Scca 5–170 alumina powder with a specific surface area of 180 $m^2$ g. After drying and calcining at 550° C., the support obtained contained zirconia in the monoclinic form. The catalyst from the impregnation step was dried and calcined at 400° C.

EXAMPLE 7 (COMPARATIVE)

Catalyst G

A catalyst G, $Co/ZrO_2$, was prepared by impregnating cobalt nitrate onto a zirconia. The cobalt metal content was 13%.

The zirconia had previously been prepared by precipitating $ZrOCl_2$ with $NH_4OH$. The freshly prepared gel was washed with ethanol. After drying and calcining at 500° C., the zirconia was monoclinic and had a specific surface area of 112 $m^2/g$. The catalyst from the impregnation step was dried and calcined at 400° C.

EXAMPLE 8

Catalytic Tests in a Three-Phase Reactor

Catalysts A, B, C, D, E, F and G prepared as described above in Examples 1-7 were tested in a perfectly stirred three-phase (slurry type) reactor functioning continuously and operating with a concentration of 10% (molar) of catalyst in suspension.

The catalysts had been reduced in advance at 400° C. for 8 hours in a mixture of hydrogen and nitrogen containing 30% hydrogen, then for 12 hours in pure hydrogen.

The catalyst test conditions were as follows:

T, ° C.=230° C.;

Pressure=2 MPa;

hourly space velocity (HSV)=1000 $h^{-1}$;

$H_2/CO$ mole ratio=2/1

TABLE 1

Conversion of synthesis gas into hydrocarbons

| Catalyst | CO conversion (% vol after 100 h) | Distribution of products formed (weight %) C1 | C5+ |
|---|---|---|---|
| A (invention) | 55 | 9 | 77 |
| B (invention) | 53 | 10 | 76 |
| C (invention) | 55 | 10 | 76 |
| D (invention) | 52 | 9 | 79 |
| E (comparative) | 50 | 11 | 54 |
| F (comparative) | 48 | 13 | 65 |
| G (comparative) | 51 | 12 | 60 |

The results of Table 1 show that the process of the invention carried out in the presence of a catalyst supported on amorphous or quadratic zirconia containing or not containing an alumina phase enjoys improved methane selectivity and a substantially improved yield of heavy products.

After 500 hours of test, the mechanical strength of catalysts A to G was evaluated by measuring the grain size of the catalysts obtained after separating the reaction products.

Table 2 below shows the % of catalyst particles with a size of less than 20 microns formed when testing catalysts A to G.

TABLE 2

Attrition resistance

| Catalyst | % of particles less than 20 microns |
|---|---|
| A (invention) | 4 |
| B (invention) | 4 |
| C (invention) | 5 |
| D (invention) | 3 |
| E (comparative) | 10 |
| F (comparative) | 8 |
| G (comparative) | 8 |

The mechanical strength of the catalysts used in the process of the invention (A to D) was substantially higher compared with catalysts E, F and G.

The invention claimed is:

1. A process for synthesising hydrocarbons from a mixture comprising carbon monoxide and hydrogen and possibly carbon dioxide C02, in the presence of a supported catalyst comprising at least one group VIII metal, the support comprising zirconia or a mixed zirconia-alumina oxide and in which the zirconia is present in the quadratic and/or amorphous form.

2. A process according to claim 1, in which said support contains at least 10% by weight of zirconia in the quadratic and/or amorphous form compared with the total weight of support and 0 to 90% by weight of alumina compared with the total weight of said support.

3. A process according to claim 2, in which said support contains at least 10% by weight of zirconia in the quadratic and/or amorphous form compared with the total weight of support and 1% to 75% by weight of alumina compared with the total weight of said support.

4. A process according to claim 1, in which said support has a specific surface area of more than 50 $m^2/g$.

5. A process according to claim 1, in which said support has a specific surface area of more than 80 $m^2/g$.

6. A process according to claim 1, in which said support contains at least one stabilizing element selected from the group formed by silicon, niobium, lanthanum, praseodymium and neodymium.

7. A process according to claim 1, in which the content of the group VIII metal is in the range 0.1% to 50% by weight with respect to the total catalyst weight.

8. A process according to claim 1, in which the group VIII metal is selected from the group formed by iron, cobalt and ruthenium.

9. A process according to claim 1, in which the group VIII metal is cobalt.

10. A process according to claim 1, in which the catalyst contains at least one activity promoter.

11. A process according to claim 1, in which the catalyst contains at least one reducibility promoter.

12. A process according to claim 1, in which the catalyst is used in suspension in a liquid phase in a three-phase reactor.

13. A process according to claim 12, in which the catalyst is in the form of a fine powder with a grain size of less than 500 μm.

* * * * *